US006305334B1

(12) United States Patent
Schuko

(10) Patent No.: US 6,305,334 B1
(45) Date of Patent: Oct. 23, 2001

(54) INTERNAL COMBUSTION ENGINE

(76) Inventor: Leonhard E. Schuko, 100 Roselena Dr., Schomberg, Ontario (CA), L0G 1T0

( * ) Notice: Subject to any disclaimer, the term of this patent is extended or adjusted under 35 U.S.C. 154(b) by 0 days.

(21) Appl. No.: 09/492,794

(22) Filed: Jan. 28, 2000

(51) Int. Cl.[7] ..... F02B 75/18
(52) U.S. Cl. ..... 123/56.2; 123/56.8; 123/56.9
(58) Field of Search ..... 123/56.1, 56.2, 123/56.5, 56.8, 56.9

(56) References Cited

U.S. PATENT DOCUMENTS

| | | | | |
|---|---|---|---|---|
| 1,788,140 | | 1/1931 | Woolson . | |
| 1,808,083 | | 6/1931 | Tibbetts . | |
| 4,565,165 | * | 1/1986 | Papanicolaou | 123/56.2 |
| 5,289,802 | | 3/1994 | Paquette et al. . | |

* cited by examiner

*Primary Examiner*—Noah P. Kamen
(74) *Attorney, Agent, or Firm*—Pillsbury Winthrop LLP

(57) ABSTRACT

A balanced five cycle internal combustion engine having first and second inlet and outlet annular cams configured to move first and second inlet and outlet pistons respectively within associated cylinders through successive five cycle repeating movements each of which includes (1) a power cycle, (2) an exhaust cycle, (3) a transfer cycle, (4) an intake cycle, and (5) a compression cycle. The movements of each first inlet piston and an associated first inlet cam follower being accompanied by an equal and opposite movement of a second inlet piston and an associated second inlet cam follower so that all movements of the first and second inlet pistons and the associated first and second inlet cam followers thereof are dynamically balanced. The movements of each first outlet piston and an associated first outlet cam follower being accompanied by an equal and opposite movement of a second outlet piston and an associated second outlet cam follower so that all movements of the first and second outlet pistons and the associated first and second outlet cam followers thereof are dynamically balanced.

13 Claims, 4 Drawing Sheets

INTERNAL COMBUSTION ENGINE

This invention relates to internal combustion engines and more particularly to improvements in five cycle engines embodying annularly arranged cylinders having opposed pistons movable by annular cam tracks.

BACKGROUND OF THE INVENTION

Five cycle engines of the type herein contemplated have been proposed in the patented literature for more than sixty-eight years. The Packard Motor Car Co. was granted U.S. Pat. No. 1,788,140, on Jan. 6, 1931, which discloses the basic five cycle engine herein contemplated.

The '140 patent discloses an internal combustion engine comprising a housing, a plurality of annularly arranged cylinders in the housing disposed with their axes parallel with a central longitudinal rotor axis. Each of the cylinders includes an inlet end portion having an inlet port therein, a central working portion, and an outlet end portion having an outlet port therein. An inlet piston is mounted in each cylinder constructed and arranged to be moved in sealing relation to the associated cylinder from an inlet end position wherein the inlet port thereof communicates with the working portion thereof in an axial direction away from the inlet end position into an inlet port cut-off position wherein the inlet piston cuts off communication of the inlet port thereof with the working portion thereof and beyond into the working portion thereof. An outlet piston is mounted in each cylinder constructed and arranged to be moved in sealing relation to the associated cylinder from an outlet end position thereof wherein the outlet port thereof is communicated with the working portion thereof in an axial direction away from the outlet end position into an outlet port cut-off position wherein the outlet piston cuts off the communication of the outlet port thereof with the working portion thereof and beyond into the working portion thereof. Rotor structure within the housing is constructed and arranged to move with a rotational movement within the housing about the central rotor axis. Each of the inlet pistons includes an inlet cam follower constructed and arranged to follow an annular inlet cam during the rotation of the rotor structure. Each of the outlet pistons includes an outlet cam follower constructed and arranged to follow an annular outlet cam during the rotation of the rotor structure. The inlet and outlet annular cams are configured to move the inlet and outlet pistons within each cylinder through a successive five-cycle repeating movement which includes (1) a power cycle wherein the inlet and outlet pistons are moved axially outwardly from combustion positions disposed in closely spaced relation within the working portion of the associated cylinder into the respective cut-off positions thereof, (2) an exhaust cycle wherein the outlet piston is moved from the outlet cut-off position thereof into the outlet end position thereof and the inlet piston is moved through the working portion thereof into close proximity to the outlet piston, (3) a transfer cycle wherein the inlet and outlet pistons are moved together in close proximity to each other through the working portion thereof, (4) an intake cycle wherein the outlet piston is initially moved through the working portion of the associated cylinder while the inlet piston is in a position allowing communication of the inlet port with the working portion with the final movement of the intake cycle resulting in the inlet and outlet pistons being in compression positions spaced from the respective end positions thereof so that the communication of the respective ports are cut off from the working portion of the associated cylinder, and (5) a compression cycle wherein the inlet and outlet pistons are moved from the compression positions thereof toward each other into the combustion positions.

The '140 patent disclosure contemplates that the compression positions of the inlet and outlet pistons in the intake cycle constitute the respective cut-off positions thereof, both of which are moved directly therein during the final movements of the intake cycle. In this way, a maximum power is achieved and opposed piston movement balance is achieved during the full movement of the opposed pistons during compression as well as during expansion.

It is noted, however, that the transfer cycle introduces an imbalance because both pistons are moved together through a full stroke. Similarly, the intake and exhaust cycles involve different movements of the pistons in the same direction.

Over the years, there have been various improvements on the basic five-cycle engine proposed in the patented literature. The Packard Motor Car Co. was granted improvement U.S. Pat. No. 1,808,083, contemporaneously with the basic '140 patent on Jun. 2, 1931. This Packard improvement was directed toward diminishing the imbalanced movement of the pistons together during the transfer cycle by essentially halving the movement required and doubling the five cycle operation to a ten cycle operation.

U.S. Pat. No. 5,289,802 introduced two features of improvement in the basic five-cycle operation. First, an increased compression-expansion ratio beyond one is proposed where the compression positions of the inlet and outlet pistons in the intake cycle constitute the cut-off position of the inlet piston and an intermediate position of the outlet piston disposed inwardly of the outlet cut-off position thereof, both of which are moved directly therein during the final movements of the intake cycle. The intake cycle is essentially accomplished by a movement of the outlet piston within the cylinder which positively displaces a new charge through the open inlet port. Second, the inlet and outlet annular cams retain the inlet and outlet pistons substantially in combustion positions longer than simple harmonic motion for a time sufficient to enable a new fueled gas charge within the minimum column to be ignited and to rise to maximum pressure before substantial volume increase toward the maximum volume during the power cycle takes place to thereby eliminate negative work resulting from ignition prior to reaching the minimum volume condition and to obtain optimal work from optimal pressure conditions.

While these improvements to some extent have a positive effect on the inherent imbalance of the basic five-cycle movement, it is apparent that the problem of inherent imbalance has gone unsolved since 1931 despite the various improvements which have been proposed over the years.

BRIEF DESCRIPTION OF THE PRESENT INVENTION

It is an object of the present invention to solve the imbalance problems inherent in the basic five cycle engine as disclosed in the '140 patent. While some of the five-cycle engine improvements of the prior art deal importantly with the imbalance problems presented, none have completely solved the problems presented. This objective is achieved in accordance with the principles of the present invention by the provision of balanced five-cycle internal combustion engine comprising a housing assembly having a longitudinal axis and a central plane perpendicular to the longitudinal axis. A plurality of first cylinders is provided in the housing assembly on one side of the central plane having parallel axes disposed in annularly spaced relation about the longitudinal axis. A plurality of second cylinders is provided in the housing assembly on an opposite side of the central plane and disposed in coaxial mirror image relation with respect to the plurality of first cylinders respectively. Each of the plurality of first and second cylinders includes an inlet end portion having an inlet port therein, a central working portion and an outlet end portion having an outlet port therein. The inlet end portion, the central working portion and the outlet end portion of said plurality of first cylinders are arranged in mirror image relation with respect to the inlet end portion, the central working portion and the outlet end portion of the plurality of second cylinders respectively. A first inlet piston is mounted in an associated first cylinder constructed and arranged to be moved in sealing relation to the associated first cylinder from an inlet end position wherein the inlet port thereof communicates with the working portion thereof in an axial direction away from the inlet end position into an inlet port cut-off position wherein the inlet piston cuts off communication of the inlet port thereof with the working portion thereof and beyond into the working portion thereof. A second inlet piston is mounted in an associated second cylinder constructed and arranged to be moved in sealing relation to the associated second cylinder from an inlet end position wherein the inlet port thereof communicates with the working portion thereof in an axial direction away from the inlet end position into an inlet port cut-off position wherein the inlet piston cuts off communication of the inlet port thereof with the working portion thereof and beyond into the working portion thereof. Each first inlet piston has a mass generally equal to the mass of a second inlet piston disposed in mirror image relation thereof, so as to be statically balanced therewith. A first outlet piston is mounted in an associated first cylinder of each of the first plurality of cylinders constructed and arranged to be moved in sealing relation to the associated cylinder from an outlet end position wherein the outlet port thereof is communicated with the working portion thereof in an axial direction away from the outlet end position into an outlet port cut-off position wherein the outlet piston cuts off the communication of the outlet port thereof with the working portion thereof and beyond into the working portion thereof. A second outlet piston is mounted in an associated second cylinder of each of the second plurality of cylinders constructed and arranged to be moved in sealing relation to the associated second cylinder from an outlet end position wherein the outlet port thereof is communicated with the working portion thereof in an axial direction away from the outlet end position into an outlet port cut-off position wherein the outlet piston cuts off the communication of the outlet port thereof with the working portion thereof and beyond into the working portion thereof. Each first outlet piston has a mass generally equal to the mass of a second outlet piston disposed in mirror image relation thereto so as to be statically balanced therewith. Rotor structure within the housing assembly is constructed and arranged to move with a rotational movement about the longitudinal axis. A first annular inlet cam is disposed annularly about the longitudinal axis on one side of the central plane. A first inlet cam follower is operatively connected between the first annular inlet cam and each of the first inlet pistons so as to effect axial movements thereof in opposite directions during the rotation of the rotor structure about the longitudinal axis. A second annular inlet cam is disposed annularly about the longitudinal axis on the opposite side of the central plane. A second inlet cam follower is operatively connected between the second annular inlet cam and each of the second inlet pistons so as to effect axial movements thereof in opposite directions during the rotation of the rotor structure about the longitudinal axis. Each first inlet cam follower has a mass generally equal to the mass of an associated second inlet cam follower disposed in mirror image relation thereto so as to be statically balanced therewith. A first annular outlet cam is disposed annularly about the longitudinal axis on the opposite side of the central plane. A first outlet cam follower is operatively connected between the first annular outlet cam and each of the first outlet pistons so as to effect axial movements thereof in opposite directions during the rotation of the rotor structure about the longitudinal axis. A second annular outlet cam is disposed annularly about the longitudinal axis on the opposite side of the central plane. A second outlet cam follower is operatively connected between the first annular outlet cam and each of the first outlet pistons so as to effect axial movements thereof in opposite directions during the rotation of the rotor structure about the longitudinal axis. Each first outlet cam follower has a mass generally equal to the mass of an associated second outlet cam follower disposed in mirror image relation thereto so as to be statically balanced therewith. The first and second inlet and outlet annular cams are configured to move the first and second inlet and outlet pistons respectively within each cylinder through a successive five cycle repeating movement which includes (1) a power cycle wherein the first and second inlet and outlet pistons are moved axially outwardly from combustion positions disposed in closely spaced relation within the working portion of the associated cylinder defining a minimum volume condition into a respective cut-off positions thereof defining a maximum volume condition, (2) an exhaust cycle wherein the first and second outlet pistons are moved from the outlet cut-off position thereof into the outlet end position thereof and the first and second inlet pistons are moved through the working portion thereof into close proximity to the first and second outlet pistons respectively, (3) a transfer cycle wherein the first and second inlet and outlet pistons are moved together in close proximity to each other through the working portion thereof, (4) an intake cycle wherein the first and second outlet pistons are initially moved through the working portion of the associated cylinder while the first and second inlet pistons respectively are in a position allowing communication of the first and second inlet ports respectively with the associated working portions with the final movement of the intake cycle resulting in the first and second inlet and outlet pistons being in compression positions spaced from the respective end positions thereof so that the communication of the respective ports are cut off from the working portion of the associated cylinder, and (5) a compression cycle wherein the first and second inlet and outlet pistons are moved from the compression positions thereof toward each other respectively into the combustion positions.

DETAILED DESCRIPTION OF THE PREFERRED EMBODIMENTS OF THE INVENTION

Figure 1:
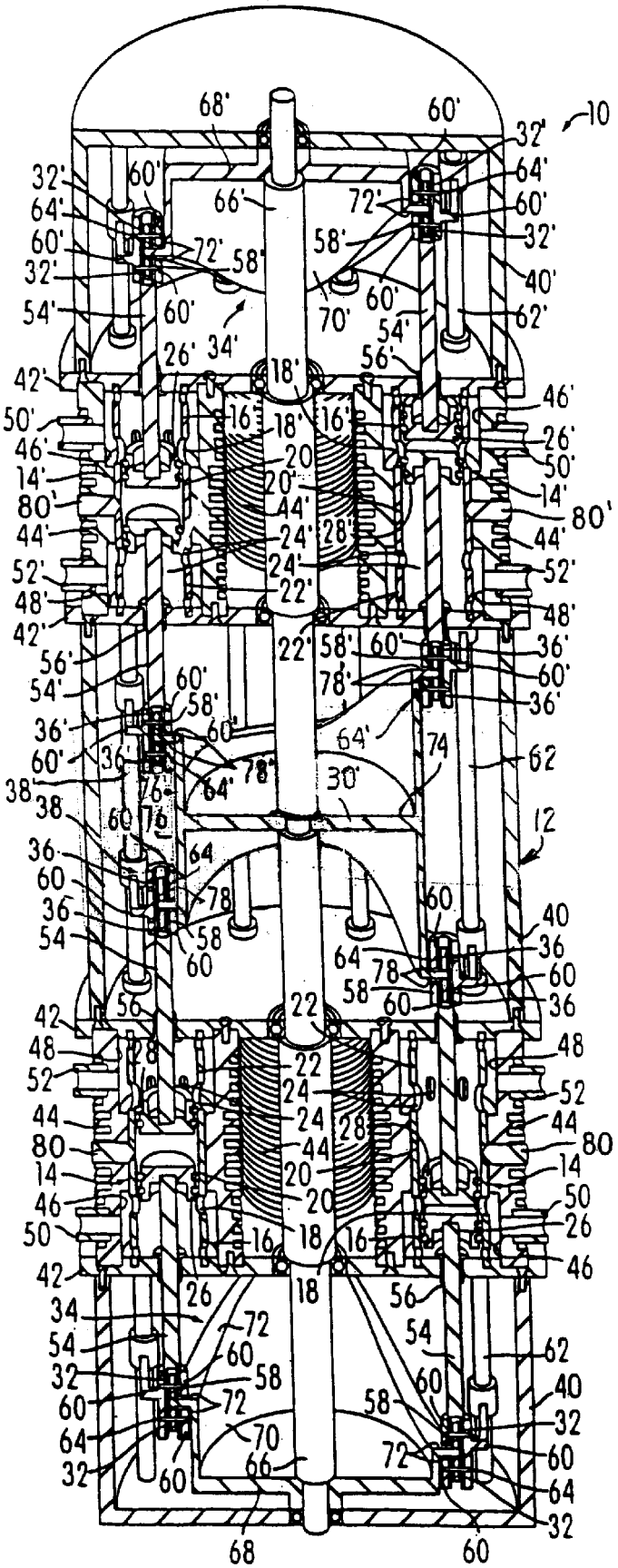
FIG. 1 is a perspective sectional view of a balanced five-cycle internal combustion engine embodying the principles of the present invention.

Referring now more particularly to FIG. 1 of the drawings, there is shown therein a balanced five-cycle combustion engine, generally indicated at 10, embodying the principles of the present invention.

The engine 10 includes a housing assembly, generally indicated at 12, having a longitudinal axis and a central plane perpendicular thereto. Within the housing assembly 12, on one side of the central plane is a plurality of annularly arranged first cylinders, generally indicated at 14, having axes which are disposed in an annularly spaced parallel relation with respect to the longitudinal axis. Disposed in the housing assembly 12 on the opposite side of the central plane is a plurality of second cylinders 14' which are arranged in coaxial mirror image relation with respect to the plurality of first cylinders 14 respectively.

Each of the plurality of first cylinders 14 has an inlet end portion 16 having one or more inlet ports 18 therein, a central working portion 20, and an outlet end portion 22 having one or more outlet ports 24 therein. Each of the plurality of second cylinders 14' has an inlet end portion 16' having one or more inlet ports 18' therein, a central working portion 20', and an outlet end portion 22° having one or more outlet ports 24' therein. The inlet end portion 16, the central working portion 20, and the outlet end portion 22 of said plurality of first cylinders 14 are arranged in mirror image relation with respect to the inlet end portion 16', the central working portion 20', and the outlet end portion 22' of the plurality of second cylinders 14' respectively.

A first inlet piston 26 is mounted in an associated first cylinder 14 of each of the plurality of first cylinders 14. Each first inlet piston 26 is constructed and arranged to be moved in sealing relation to the associated first cylinder 14 from an inlet end position wherein the inlet ports 18 thereof communicates with the working portion 20 thereof. Each first inlet piston 26 moves in an axial direction away from the inlet end position into an inlet port cut-off position wherein the first inlet piston 26 cuts off communication of the inlet port 18 of the associated first cylinder 14 with the working portion 20 thereof and beyond into the working portion 20 thereof.

A second inlet piston 26' is mounted in an associated second cylinder 14' of each of the plurality of second cylinders 14'. Each second inlet piston 26' is constructed and arranged to be moved in sealing relation to the associated second cylinder 14' from an inlet end position wherein the inlet ports 18' thereof communicates with the working portion 20' thereof. Each second inlet piston 26' moves in an axial direction away from the inlet end position into an inlet port cut-off position wherein the second inlet piston 26' cuts off communication of the inlet port 18' of the associated second cylinder 14' with the working portion 20' thereof and beyond into the working portion 20' thereof.

Each first inlet piston 26 has a mass generally equal to the mass of an associated second inlet piston 26' arranged in mirror image relation thereto so as to be statically balanced therewith.

A first outlet piston 28 is mounted in an associated first cylinder 14 of each of the first plurality of cylinders 14 and is constructed and arranged to be moved in sealing relation thereto from an outlet end position 20 wherein the outlet ports 24 thereof communicate with the working portion 20 thereof. Each first outlet piston 28 moves in an axial direction away from the outlet end position into an outlet port cut-off position wherein the outlet piston 28 cuts off the communication of the outlet ports of the associated first cylinder 14 with the working portion 20 thereof and beyond into the working portion 20 thereof.

A second outlet piston 28' is mounted in an associated second cylinder 14' of each of the second plurality of cylinders 14' and is constructed and arranged to be moved in sealing relation thereto from an outlet end position 20' wherein the outlet ports 24' thereof communicate with the working portion 20' thereof. Each second outlet piston 28' moves in an axial direction away from the outlet end position into an outlet port cut-off position wherein the outlet piston 28' cuts off the communication of the outlet ports of the associated second cylinder 14' with the working portion 20' thereof and beyond into the working portion 20' thereof.

Each first outlet piston 28 has a mass generally equal to the mass of an associated second outlet piston 28' arranged in mirror image relation thereto so as to be statically balanced therewith.

A rotor structure, generally indicated at 30, is mounted within the housing assembly 12 and is constructed and arranged for rotational movement therein about the longitudinal axis.

Each of the first inlet pistons 26 includes a first inlet cam follower in the form of a pair of axially spaced rollers 32 constructed and arranged to follow a first annular inlet cam 34, disposed annularly about the longitudinal axis on one side of the central plane, during the rotation of rotor structure 30 so as to effect axial movements thereof in opposite directions.

Each of the second inlet pistons 26' includes a second inlet cam follower in the form of a pair of axially spaced rollers 32' constructed and arranged to follow a second annular inlet cam 34', disposed annularly about the longitudinal axis on the opposite side of the central plane, during the rotation of rotor structure 30 so as to effect axial movements thereof in opposite directions.

Each first inlet cam follower 32 has a mass generally equal to the mass of an associated second inlet cam follower 32' and is arranged in mirror image relation thereto so as to be statically balanced therewith.

Each of the first outlet pistons 28 includes a first outlet cam follower in the form of a pair of axially spaced rollers 36 constructed and arranged to follow a first annular outlet cam 38, disposed annularly about the longitudinal axis on one side of the central plane, during the rotation of rotor structure 30 so as to effect axial movements thereof in opposite directions.

Each of the second outlet pistons 28' includes a second outlet cam follower in the form of a pair of axially spaced rollers 36' constructed and arranged to follow a second annular outlet cam 38', disposed annularly about the longitudinal axis on the opposite side of the central plane, during the rotation of rotor structure 30 so as to effect axial movements thereof in opposite directions.

Each first outlet cam follower 36 has a mass generally equal to the mass of an associated second outlet cam follower 36' and is arranged in mirror image relation thereto so as to be statically balanced therewith.

The first inlet and outlet annular cams, 34 and 38, are configured to move the first inlet and outlet pistons, 26 and 28, within each first cylinder 14 through a successive five-cycle repeating movement which includes (1) a power cycle wherein the first inlet and outlet pistons, 26 and 28, are moved axially outwardly from combustion positions disposed in closely spaced relation within the working portion 20 of the associated cylinder 14 defining a minimum volume condition into the respective cut-off positions thereof defining a maximum volume condition;

(2) an exhaust cycle wherein the first outlet piston 28 is moved from the outlet cut-off position thereof into the outlet end position thereof and the first inlet piston 26 is moved through the working portion 20 thereof into close proximity to the first outlet piston 28;

(3) a transfer cycle wherein the first inlet and outlet pistons, 26 and 28, are moved together in close proximity to each other through the working portion 20 of the associated first cylinder 14;

(4) an intake cycle wherein the first outlet piston 28 is initially moved through the working portion 20 of the associated first cylinder 14 and into the outlet end position and thereafter the first inlet piston 26 is moved beyond the inlet cut-off position within the associated first cylinder 14, and during the latter portion of this movement, the first outlet piston 28 is moved from the outlet end position thereof into the outlet cut-off position thereof resulting in the first inlet and outlet pistons, 26 and 28, being in compression positions spaced from the respective end positions thereof so that the communication of the respective ports, 18 and 24, are cut off from the working portion 20 of the associated first cylinder 14;

and (5) a compression cycle wherein the first inlet and outlet pistons, 26 and 28, are moved from the compression positions thereof toward each other into the combustion positions.

The second inlet and outlet annular cams, 34' and 38', are configured to move the second inlet and outlet pistons, 26' and 28', within each second cylinder 14' through a successive five-cycle repeating movement which includes (1) a power cycle wherein the second inlet and outlet pistons, 26' and 28', are moved axially outwardly from combustion positions disposed in closely spaced relation within the working portion 20' of the associated cylinder 14' defining a minimum volume condition into the respective cut-off positions thereof defining a maximum volume condition, (2) an exhaust cycle wherein the second outlet piston 28' is moved from the outlet cut-off position thereof into the outlet end position thereof and the second inlet piston 26' is moved through the working portion 20' thereof into close proximity to the second outlet piston 28';

(3) a transfer cycle wherein the second inlet and outlet pistons, 26' and 28', are moved together in close proximity to each other through the working portion 20' of the associated second cylinder 14';

(4) an intake cycle wherein the second outlet piston 28' is initially moved through the working portion 20' of the associated second cylinder 14' and into the outlet end position and thereafter the second inlet piston 26' is moved beyond the inlet cut-off position within the associated second cylinder 14', and during the latter portion of this movement, the second outlet piston 28' is moved from the outlet end position thereof into the outlet cut-off position thereof resulting in the second inlet and outlet pistons, 26' and 28', being in compression positions spaced from the respective end positions thereof so that the communication of the respective ports, 18' and 24', are cut off from the working portion 20' of the associated second cylinder 14';

(5) a compression cycle wherein the second inlet and outlet pistons, 26' and 28', are moved from the compression positions thereof toward each other into the combustion positions.

The movements of each first inlet piston 26 and an associated first inlet cam follower 32 being accompanied by an equal and opposite movement of a second inlet piston 26' and an associated second inlet cam follower 32' so that all movements of the first and second inlet pistons, 26 and 26', and the associated first and second inlet cam followers, 32 and 32', thereof are dynamically balanced.

The movements of each first outlet piston 28 and an associated first outlet cam follower 36 being accompanied by an equal and opposite movement of a second outlet piston 28' and an associated second outlet cam follower 36' so that all movements of the first and second outlet pistons, 28 and 28', and the associated first and second outlet cam followers, 36 and 36', thereof are dynamically balanced.

While it is contemplated in the broadest aspects of the present invention that the first cylinders 14 could be rotated with the rotor structure 30 and the first inlet and outlet annular cams, 34 and 38, fixed with respect to the housing assembly 12, it is preferable in accordance with the principles of the present invention to fix the first inlet and outlet annular cams 34 and 38 to the rotor structure 30 so that they rotate therewith and to fix the first cylinders 14 with respect to the housing assembly 12.

While it is also contemplated in the broadest aspects of the present invention that the second cylinders 14' could be rotated with the rotor structure 30 and the second inlet and outlet annular cams, 34' and 38', fixed with respect to the housing assembly 12, it is preferable in accordance with the principles of the present invention to fix the second inlet and outlet annular cams 34' and 38' to the rotor structure 30 so that they rotate therewith and to fix the second cylinders 14' with respect to the housing assembly 12.

It will be understood that the housing assembly 12 may assume different constructions. In the exemplary embodiment shown in the drawings, on one side of the central plane, the housing assembly 12 includes a pair of cup-shaped end housing members 40 which are disposed in spaced relation opening toward one another. The open end of each outer end housing member 40 is fixed to a transverse housing wall or disk 42 which essentially covers the open end thereof. Between the two housing walls 42, a plurality of first cylinder housing members 44 are fixedly mounted with the ends thereof seated in annular grooves in the housing walls 42. Each first cylinder housing member 44 receives a first cylinder 14 therein with the central portion 20 thereof being engaged within the associated first cylinder housing member 44 and the marginal ends thereof seated within annular grooves in the housing walls 42. Each first cylinder housing member 44 has an enlarged bore forming a first inlet chamber 46 which communicates with the inlet ports 18 of the associated first cylinder 14. Each first cylinder housing member 44 also has an enlarged bore forming a first outlet chamber 48 which communicates with the outlet ports 24 of the associated first cylinder 14. In the embodiment shown, there are four first cylinders 14 and surrounding housing members 44 although it will be understood that less than four or more than four may be provided.

In the exemplary embodiment shown in the drawings, on the other side of the central plane, the housing assembly 12 includes a pair of cup-shaped end housing members 40 which are disposed in spaced relation opening toward one another. The open end of each outer end housing member 40 is fixed to a transverse housing wall or disk 42' which essentially covers the open end thereof. Between the two housing walls 42', a plurality of second cylinder housing members 44' are fixedly mounted with the ends thereof seated in annular grooves in the housing walls 42'. Each second cylinder housing member 44' receives a second cylinder 14' therein with the central portion 20' thereof being engaged within the associated second cylinder housing member 44' and the marginal ends thereof seated within annular grooves in the housing walls 42'. Each second cylinder housing member 44' has an enlarged bore forming a second inlet chamber 46' which communicates with the inlet ports 18' of the associated second cylinder 14'. Each second cylinder housing member 44' also has an enlarged bore forming a second outlet chamber 48' which communicates with the outlet ports 24' of the associated second cylinder 14'. In the embodiment shown, there are four second cylinders 14' and surrounding housing members 44' although it will be understood that less than four or more than four may be provided.

The first inlet and outlet chambers 46 and 48 could be intercommunicated between the housing walls 42 to form first inlet and outlet manifolds. However, as shown each first inlet chamber 46 has a radially extending first inlet tube 50 communicating therewith which leads to a suitable first inlet manifolding if desired (not shown). Similarly, each first outlet chamber 48 has a radially extending first outlet tube 52 communicating therewith which also may lead to a suitable first outlet manifolding if desired (not shown).

The second inlet and outlet chambers 46' and 48' could be intercommunicated between the housing walls 42' to form second inlet and outlet manifolds. However, as shown each second inlet chamber 46' has a radially extending second inlet tube 50' communicating therewith which leads to a suitable second inlet manifolding if desired (not shown). Similarly, each second outlet chamber 48' has a radially extending second outlet tube 52' communicating therewith which also may lead to a suitable second outlet manifolding if desired (not shown).

Each first inlet and outlet pair of cam follower rollers 32 and 36 is rotatably carried by the associated first inlet and outlet pistons 26 and 28 by a piston rod 54 fixed at one end thereto which extends in sliding guided relation through a sleeve 56 in the associated housing wall 42. The free end of each piston rod 54 is bifurcated to receive an associated first inlet roller 32 or outlet roller 36, which is mounted on a shaft 58 extending through the bifurcation. Each piston rod 54 is also fixedly connected adjacent its bifurcated end to the central portion of a cross member 60. The ends of each cross member 60 are sleeved to slidably engage a pair of spaced axially extending cylindrical guide members 62. Each cross member 60 has a shaft 64 fixed thereto on which the other roller 32 or 36 of the associated pair is journaled. In this way, each first inlet cam follower roller 32 and each first outlet cam follower roller 36 is guided for axial movement in opposite directions to follow the associated first annular inlet and outlet cam 34 and 38 during the rotation of the rotor structure 30.

Each second inlet and outlet pair of cam follower rollers 32' and 36' is rotatably carried by the associated second inlet and outlet pistons 26' and 28' by a piston rod 54' fixed at one end thereto which extends in sliding guided relation through a sleeve 56' in the associated housing wall 42'. The free end of each piston rod 54' is bifurcated to receive an associated second inlet roller 32' or outlet roller 36', which is mounted on a shaft 58' extending through the bifurcation. Each piston rod 54' is also fixedly connected adjacent its bifurcated end to the central portion of a cross member 60'. The ends of each cross member 60' are sleeved to slidably engage a pair of spaced axially extending cylindrical guide members 62. Each cross member 60' has a shaft 64' fixed thereto on which the other roller 32' or 36' of the associated pair is journaled. In this way, each second inlet cam follower roller 32' and each second outlet cam follower roller 36' is guided for axial movement in opposite directions to follow the associated second annular inlet and outlet cam 34' and 38' during the rotation of the rotor structure 30.

The first annular inlet cam 34 and first annular outlet cam 36 are each generally in the shape of an exteriorly flanged cup with an irregularly shaped peripheral wall. As previously indicated, the cams 34 and 38 are fixed to the rotor structure 50 to rotate therewith. The rotor structure 50 includes a main shaft 66 suitably journaled in the end housing members 40 and interior housing walls 42. Fixed to the main shaft 66 inwardly of the first inlet end thereof is a first inlet cam rotor disk member 68 having a cylindrical inlet cam rotor wall 70 extending axially from the outer periphery thereof a variable distance throughout its annular extent. The first inlet cam 34 is specifically in the form of a radially outwardly extending flange on the free end of the cylindrical wall 70 which extends between each pair of first inlet cam follower rollers 32. Cam 34 has opposed cam surfaces 72 on which the roller 32 roll.

The second annular inlet cam 34' and second annular outlet cam 36' are each generally in the shape of an exteriorly flanged cup with an irregularly shaped peripheral wall. As previously indicated, the cams 34' and 38' are fixed to the rotor structure 50' to rotate therewith. The rotor structure 50' includes a main shaft 66' suitably journaled in the end housing members 40' and interior housing walls 42'. Fixed to the main shaft 66' inwardly of the second inlet end thereof is a second inlet cam rotor disk member 68' having a cylindrical inlet cam rotor wall 70' extending axially from the outer periphery thereof a variable distance throughout its annular extent. The second inlet cam 34' is specifically in the form of a radially outwardly extending flange on the free end of the cylindrical wall 70', which extends between each pair of second inlet cam follower rollers 32'. Cam 34' has opposed cam surfaces 72' on which the roller 32' roll.

A similar outlet cam rotor disk member 74 is fixed to the main shaft 66 inwardly of the first outlet end thereof. A similar first outlet cam rotor cylindrical wall 76 extends axially from the outer periphery of the disk member 74. The cylindrical wall 76 includes a radially outwardly extending flange which defines the first outlet cam 38 and has opposed cam surfaces 78 on which each pair of first outlet cam follower rollers 36 roll.

A similar outlet cam rotor disk member 74 is fixed to the main shaft 66' inwardly of the second outlet end thereof. A similar second outlet cam rotor cylindrical wall 76' extends axially from the outer periphery of the disk member 74. The cylindrical wall 76' includes a radially outwardly extending flange which defines the second outlet cam 38' and has opposed cam surfaces 78' on which each pair of second outlet cam follower rollers 36' roll.

FIG. 1 schematically illustrates first and second diesel fuel injectors, 80 and 80', mounted to extend within and eject a charge of fuel into the central area of the associated working portion, 20 and 20', of the associated first and second cylinders, 14 and 14', respectively. Other conventional support equipment suitable for compression ignition combustion operation of the engine 10 are to be provided but are not shown. It will also be understood that the injectors 80 and 80' could be replaced by spark plugs (not shown) and the support equipment suitable for spark ignition combustion operation could be provided. In the description to follow, compression ignition combustion is the mode of operation but it will be understood that the description is equally applicable to spark ignition combustion taking into account the different compression ratio required.

OPERATION OF THE EMBODIMENT OF FIGS. 1–12

It will be understood that the cams 32 and 36, and the cams 32' and 36', are preferably shaped to provide two mirror-image five-cycle repetitive movements during each revolution of the cams 32 and 36, and 32' and 36', respectively with the rotor structure 30. However, it is within the contemplation of the present invention to provide four or more five-cycle repetitive movements in multiples of two during each revolution. While a full five-cycle movement will be performed in each of the eight cylinders during each revolution, the start and end for each pair of mirror image cylinders will be different, being effectively displaced 90° from one to another.

Figure 12:
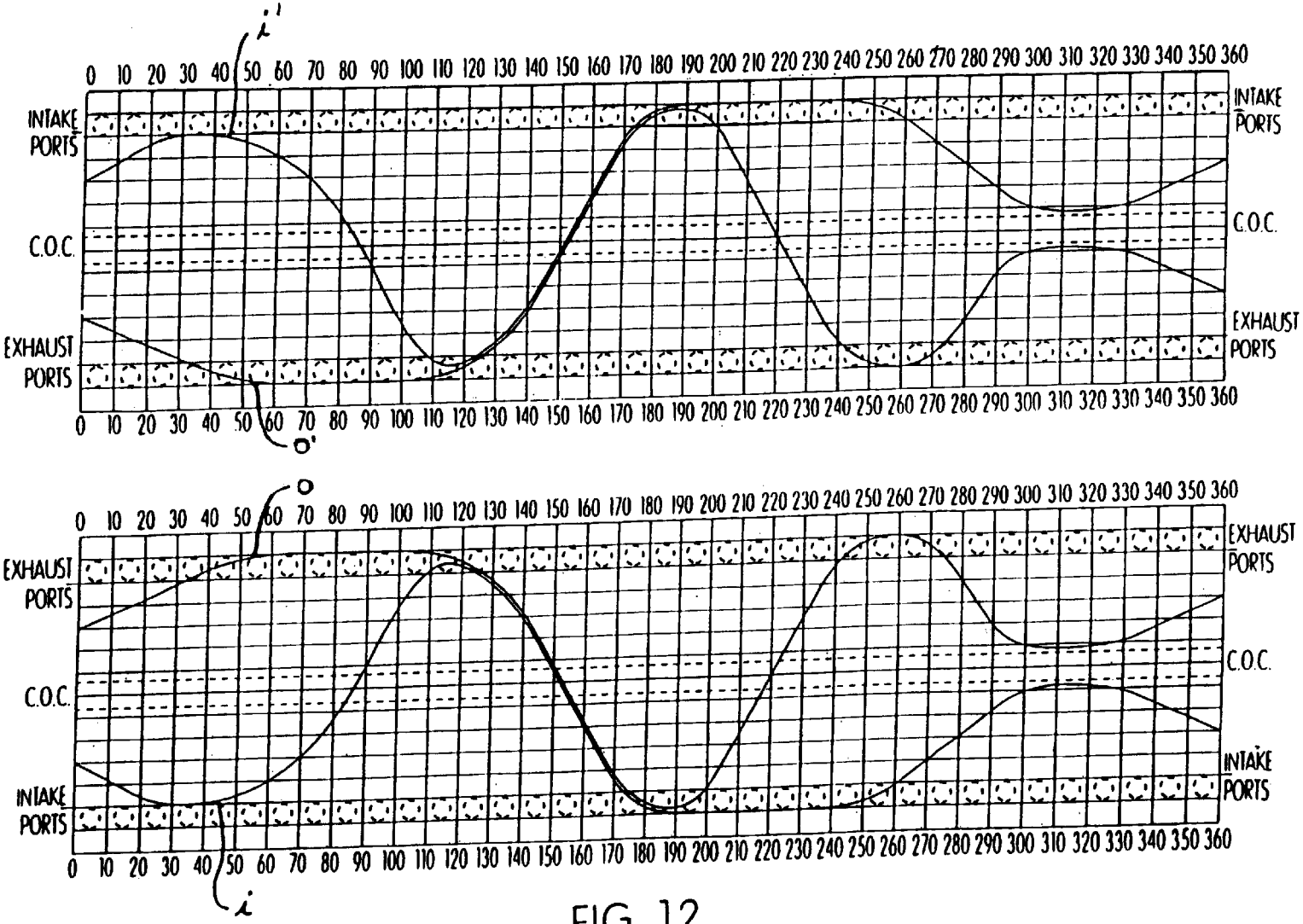
FIG. 12 is a layout drawing showing the configuration of the cam surfaces in relation to a single rotational movement of the rotor structure.

However, because the cam contours and the resultant piston movements are modified in relation to simple harmonic motion from the moment of ignition to the moment of the establishment of maximum pressure in the piston movement graph shown in FIG. 12, the first 30° of cam movement has been transposed to the end so that the area of the graph where ignition occurs will be shown in continuity. The lines indicated at i and o in the graph of FIG. 12, represent the positions of the inner surfaces of a pair of first inlet and outlet pistons 26 and 28 respectively within the associated first cylinder 14 during a 360° turn of the cams 32 and 36. The lines indicated at i' and o' in the graph of FIG. 12, represent the positions of the inner surfaces of a pair of second inlet and outlet pistons 26' and 28' respectively within the associated second cylinder 14' during a 360° turn of the cams 32' and 36'.

Figures 2, 3, 4, 5, 6:
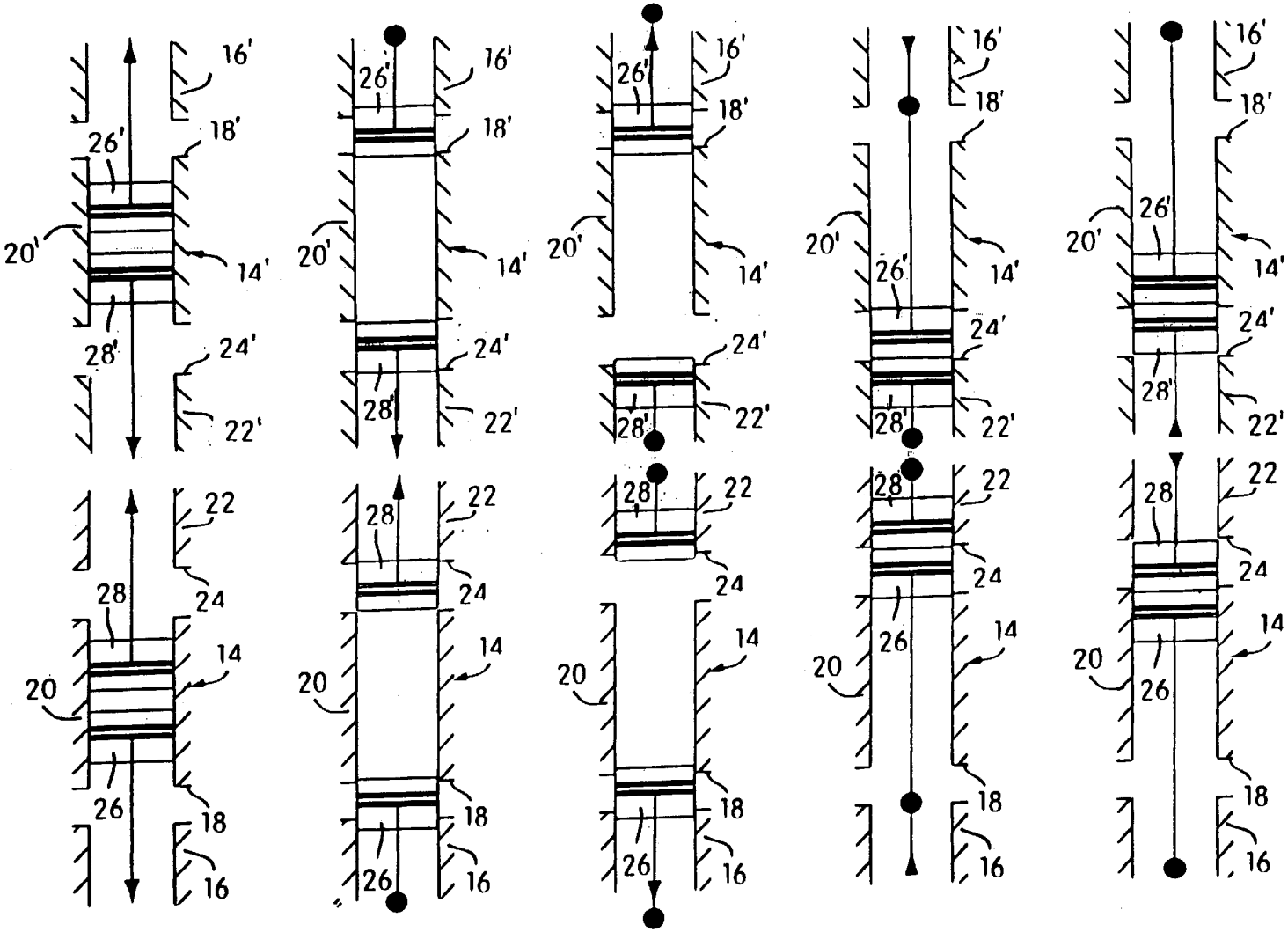
FIG. 2 is a somewhat schematic view showing the relationship between the pistons and the cylinder ports at the end of the compression cycle and the start of the power cycle of the engine shown in FIG. 1.
FIG. 3 is a view similar to FIG. 2 showing the relationship between the pistons and the cylinder ports at the end of the power stroke and the beginning of the exhaust cycle.
FIG. 4 is a view similar to FIG. 2 showing the relationship between the pistons and the cylinder ports at the end of the initial movement of the first and second outlet pistons during the exhaust cycle.
FIG. 5 is a view similar to FIG. 2 showing the relationship between the pistons and the cylinder ports at the end of the first and second inlet piston movement during the exhaust cycle.
FIG. 6 is a view similar to FIG. 2 showing the relationship between the pistons and the cylinder ports at the end of the exhaust cycle and the beginning of the transfer cycle.

In the graph shown in FIG. 12, the first pistons 26 and 28, and the second pistons 26' and 28', are in the positions at the end of compression shown in FIG. 2 at the 310° cam position. The cam surfaces 72 and 78, and 72' and 78', are modified during the expansion cycle so as to accomplish a movement of each first piston 26 and 28, and second piston 26' and 28', respectively which is different from simple harmonic movement. The difference is that the cam surfaces 72 and 78, and 72' and 78', are modified to provide that the first pistons 26 and 28, and second pistons 26' and 28', respectively stay in the position of FIG. 2 or nearly so without materially increasing the cylinder volume for a period longer than is provided by simple harmonic motion. This modification enables ignition to occur after the minimum volume condition is reached rather than before as is the case with engines tied to simple harmonic motion.

It will be understood that where ignition occurs before minimum volume is reached, the pressure will increase as a result of the expenditure of power as the volume is decreasing so that negative work results. By allowing compression to proceed to minimum volume conditions without ignition, this negative work is eliminated.

The dwell or substantial dwell at minimum volume or nearly so continues for a time period sufficient to enable maximum pressure to develop in the working portion 20 of the first cylinder 14, and in the working portion 20' of the second cylinder 14', before or substantially before the expansion or power cycle begins. In contrast, engines tied to simple harmonic motion begin the expansion cycle before the time necessary to ensure that maximum pressure can be established and the increase in volume at the beginning of the expansion cycle has the effect of limiting the maximum pressure that can be established during the beginning movements of the expansion cycle.

The preferred starting position of the first inlet and outlet pistons 26 and 28, and second inlet and outlet pistons 26' and 28', in relation to the first inlet and outlet cylinder ports 18 and 24, and second inlet and outlet cylinder ports 18' and 24', respectively at the beginning of the power or expansion cycle is shown in FIG. 2. The first pistons 26 and 28, and second pistons 26' and 28', have just completed a compression cycle and each is at a position equivalent to top dead center or nearly so. As previously indicated, preferably combustion has been substantially completed and maximum pressure has been generated as the power cycle commences with the movement of the first pistons 26 and 28 away from one another, and with the movement of the second pistons 26' and 28' away from one another. The power cycle is characterized by substantially equal and opposite balanced movements of the first pistons 26 and 28, and second pistons 26' and 28', until they substantially simultaneously reach their respective port cut-off positions, as shown in FIG. 3. More importantly during this movement, the first inlet piston 26 moves in more exactly an equal and opposite direction with respect to the second inlet piston 26' and this same balanced relationship exists between the first outlet piston 28 and the second outlet piston 28'. As best shown in FIG. 12, the dwell period is approximately 20° of cam rotation and the power cycle is completed after approximately 60° of rotational movement of the cams 32 and 36, and cams 32' and 36', thereafter.

It will be understood that precise simultaneous movements of the first pistons 26 and 28, and second pistons 26' and 28', at the end of the expansion stroke would require that both first pistons 26 and 28, and second pistons 26' and 28', respectively be brought to a halt as the cut-off position is reached. It is possible and preferred to continue the outward movement of the first outlet piston 28, and second outlet piston 28', beyond its outlet port cut-off position while the first inlet piston 26, and second inlet piston 26', is being brought to a halt at its inlet cut-off position. While this difference will make inlet pistons 26 and 26' out of balance with outlet pistons 28 and 28' respectively, balance is still obtained by virtue of the aforesaid balanced relationship between inlet pistons 26 and 26' and outlet pistons 28 and 28'. Consequently, the beginning of the exhaust cycle, as best shown in FIG. 4, is characterized by a final movement of the first inlet piston 26, and second inlet piston 26', into its inlet port cut-off position as the outlet ports 24, and 24', are opened to initially relieve the pressure within working portion 20, and 20', of the first cylinder 14, and second cylinder 14', respectively. The first inlet piston 26, and second inlet piston 26', is now in a position to move entirely through the working portion 20, and 20', of the associated cylinder to positively displace all of the spent gases therein outwardly through the open outlet ports 24, and 24'.

The initial positive displacement movement of the first inlet piston 26, and second inlet piston 26', takes place simultaneously with the movement of the first outlet piston 28, and second outlet piston 28', respectively into its outlet end position. During this movement, a balanced relationship exists due to the equal and opposite movements of pistons 26 and 26' and that of pistons 28 and 28'. The next movement during the exhaust cycle is by the inlet piston 26, and 26' while the outlet piston 28, and 28', respectively is retained in its outlet end position. The inlet piston 26, and 26' moves completely through the working portion 20, and 20', of the associated cylinder 14, and 14', respectively until it substantially reaches the position shown in FIG. 5. This movement positively displaces all of the spent gases within the working portion 20, and 20', of the associated first cylinder 14, and second cylinder 14', respectively but leaves the gas volume between the two pistons 26 and 28, and 26' and 28', respectively. The last movement in the exhaust cycle is a relative movement of the two pistons 26 and 28, and 26' and 28', toward one another into a position substantially in abutting relation with one another so as to positively displace all of the gas therebetween through the open exhaust ports 24, and 24'. As shown, the two pistons 26 and 28, and 26' and 28', reach the abutting relationship with the outlet piston 28, and 28', having moved almost to its outlet port cut-off position. It could be at any position between the outlet end position and the outlet port cut-off position thereof. During this movement, the outlet ports 24, and 24' are effectively closed and substantially the last volume of gas between the two pistons 26 and 28, and 26' and 28' is positively displaced through the outlet ports 24, and 24' as they are closed. The final position is shown in FIG. 6 and it can be seen from FIG. 12 that, during the exhaust cycle, the initial movement of the outlet piston 28, and 28', is completed within approximately 28° of rotational cam movement, the movement of the inlet piston 26, and 26', through the working portion 20, and 20', of the associated first cylinder 14, and second cylinder 14', is completed in approximately 80° of rotational movement and the final movement of the outlet piston 26, and 26', is accomplished thereafter in approximately 72° of rotational movement. A continuous balance across the central plane is obtained throughout the movements due to the equal and opposite relationship between pistons 26 and 26' and pistons 28 and 28'.

The transfer cycle begins with the pistons 26 and 28, and 26' and 28', disposed in substantially abutting relation within the associated first cylinder 14, and second cylinder 14', as shown in FIG. 6, which is the same as the position at the end of the exhaust cycle. The transfer cycle is characterized by a movement of the inlet and outlet pistons 26 and 28, and 26' and 28', together in substantially abutting relation from the position shown in FIG. 6 into the position shown in FIG. 7, wherein the inlet piston 26, and 26', is in the inlet end portion thereof. This movement is accomplished in approximately 52° of rotational cam movement.

Figure 7:
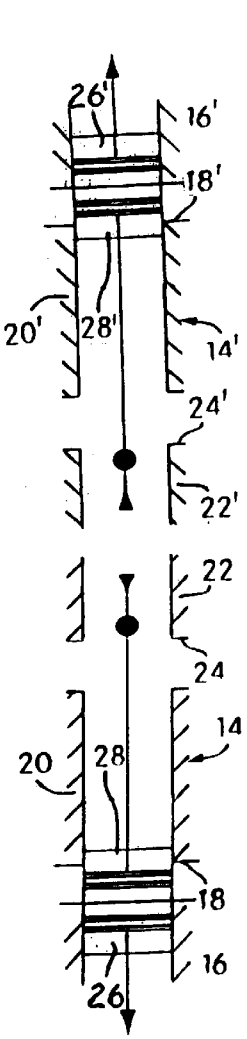
FIG. 7 is a view similar to FIG. 2 showing the relationship between the pistons and the cylinder ports at the end of the transfer cycle and the beginning of the intake cycle.

When the two pistons 26 and 28, and 26' and 28', reach the end of the transfer cycle, as shown in FIG. 7, they are now ready to begin the intake cycle.

Figure 9:
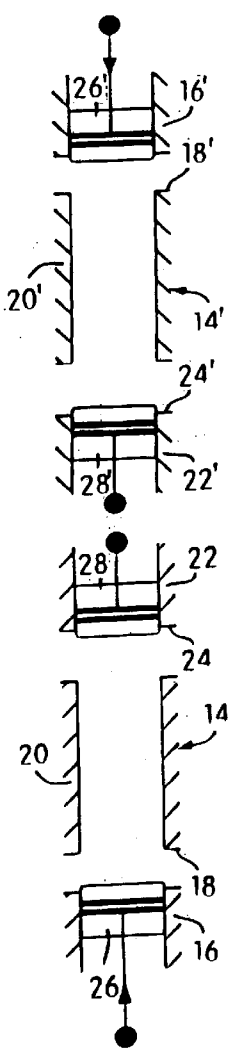
FIG. 9 is a view similar to FIG. 2 showing the relationship between the pistons and the cylinder ports after an initial movement of the first and second outlet pistons during the intake cycle.
Figure 8:
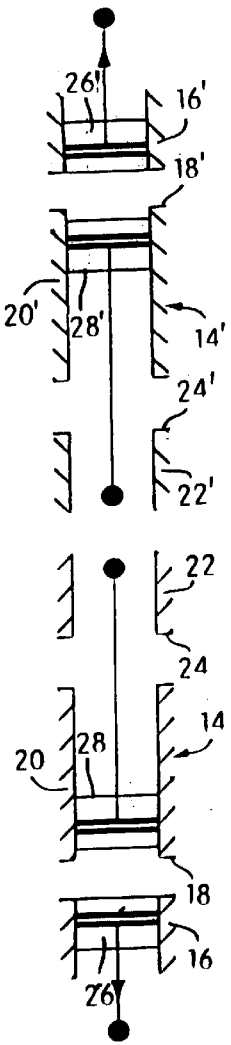
FIG. 8 is a view similar to FIG. 2 showing the relationship between the pistons and the cylinder ports after the initial movement of the inlet piston during the intake cycle.

The intake cycle in accordance with the improvement of the present invention begins after the transfer cycle with the pistons 26 and 28, and 26' and 28', in the position shown in FIG. 7. The initial movement of the intake cycle is a movement of the outlet piston 28, and 28', from the position shown in FIG. 7 through the working portion 20, and 20', of the associated first cylinder 14, and second cylinder 14', and into the outlet end position thereof, as shown in FIG. 9.

Figure 10:
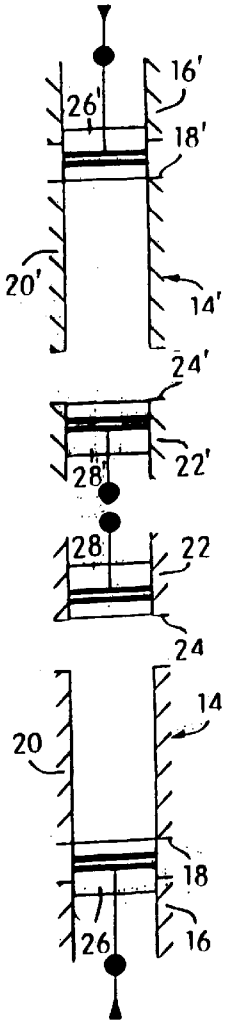
FIG. 10 is a view similar to FIG. 2 showing the relationship between the pistons and the cylinder ports after a movement of the first and second inlet pistons during the intake cycle.

This movement fills the volume between the two pistons 26 and 28, and 26' and 28', with a fresh charge of air coming from the open inlet ports 18, and 18', which also communicates with the open outlet ports 24, and 24'. The next movement which takes place in the intake cycle according to the present improvement is a movement of the inlet piston 26, and 26', from the inlet end position thereof into the inlet port cut-off position thereof as shown in FIG. 10. At the end of this movement, the communication of the fresh charge of air between the pistons 26 and 28, and 26' and 28', is cut off from the inlet ports 18, and 18'. As the inlet piston 26, and 26' passes the inlet port cut-off position, the charge is still communicated with the outlet ports 24, and 24', but the outlet piston 28, and 28', begins a movement away from its outlet end position. As the inlet piston 26, and 26', passes the cut-off position, a shock wave of displaced air is sent through the open outlet ports 24, and 24', into the exhaust system by the movement of the displaced air volume. The air dilutes the exhausting gases and thus dilutes the pollution content of the exhausting gases. The intake cycle ends as the inlet piston 26, and 26', reaches the compression position thereof simultaneously as the outlet piston 28, and 28', reaches the outlet port cut-off position thereof, as shown in FIG. 11.

Figure 11:
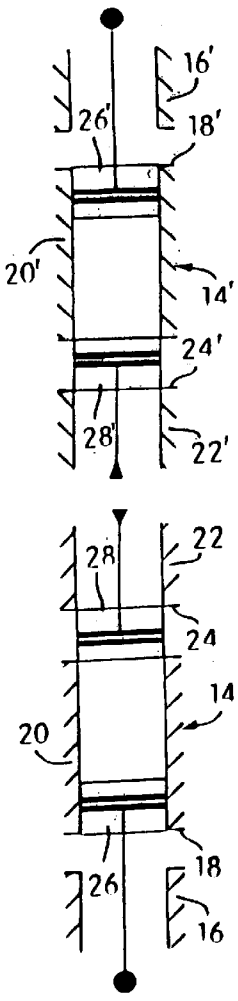
FIG. 11 is a view similar to FIG. 2 showing the relationship between the pistons and the cylinder ports at the end of the intake cycle and the beginning of the compression cycle.

Consequently, the compression positions of the pistons shown in FIG. 11 at the start of the compression cycle with the volume of fresh air is trapped within the working portion 20, and 20', of the associated cylinder which is less than the full volume of the working portion 20, and 20', of the associated first cylinder 14, and second cylinder 14'. The compression cycle includes movements of both pistons 26 and 28, and 26' and 28'. During this movement, the outlet piston 28, and 28', moves a greater distance than the inlet piston 26, and 26'. The displaced volume during the power cycle is more than the displaced volume during the compression cycle and hence the increased expansion obtains increased efficiency.

The initial movement of the outlet piston 28, and 28', is accomplished in 70° of rotational cam movement, the movement of the inlet piston 26, and 26', into the working portion 20, and 20', of the associated first cylinder 14, and second cylinder 14', is accomplished in 33° of rotational movement, and the final movement of the outlet piston 28, and 28', is accomplished in 13° of rotational cam movement. During the compression stroke, the movements of the two pistons 26 and 28, and 26' and 28', together into the combustion positions thereof is accomplished in 40° of rotational cam movement.

While the cyclic movements described above are preferred in the broadest aspects of the present invention, the cyclic movements can be the basic movements as described in the basic five cycle '140 patent or the cyclic movements of the improvement '802 patent.

It thus will be seen that the objects of this invention have been fully and effectively accomplished. It will be realized, however, that the foregoing specific embodiment has been shown and described for the purpose of this invention and is subject to change without departure from such principles. There, this invention includes all modifications encompassed within the spirit and scope of the following claims.

What is claimed is:

1. A balanced five cycle internal combustion engine comprising:

a housing assembly having a longitudinal axis and a central plane perpendicular to said longitudinal axis, a plurality of first cylinders in said housing assembly on one side of said central plane having parallel axes disposed in annularly spaced relation about said longitudinal axis, a plurality of second cylinders in said housing assembly on an opposite side of said central plane and disposed in coaxial mirror image relation with respect to said plurality of first cylinders respectively, each of said plurality of first and second cylinders each including an inlet end portion having an inlet port therein, a central working portion and an outlet end portions having an outlet port therein, the inlet end portion, the central working portion and the outlet end portion of said plurality of first cylinders being arranged in mirror image relation with respect to the inlet end portion, the central working portion and the outlet end portion of said plurality of second cylinders respectively, a first inlet piston mounted in an associated first cylinder constructed and arranged to be moved in sealing relation to the associated first cylinder from an inlet end position wherein the inlet port thereof communicates with the working portion thereof in an axial direction away from said inlet end position into an inlet port cut-off position wherein said inlet piston cuts off communication of the inlet port thereof with the working portion thereof and beyond into the working portion thereof, a second inlet piston mounted in an associated second cylinder constructed and arranged to be moved in sealing relation to the associated second cylinder from an inlet end position wherein the inlet port thereof communicates with the working portion thereof in an axial direction away from said inlet end position into an inlet port cut-off position wherein said inlet piston cuts off communication of the inlet port thereof with the working portion thereof and beyond into the working portion thereof, each first inlet piston having a mass generally equal to the mass of a second inlet piston disposed in mirror image relation thereof so as to be statically balanced therewith, a first outlet piston mounted in an associated first cylinder of each of said first plurality of cylinders constructed and arranged to be moved in sealing relation to the associated cylinder from an outlet end position wherein the outlet port thereof is communicated with the working portion thereof in an axial direction away from said outlet end position into an outlet port cut-off position wherein said outlet piston cuts off the communication of the outlet port thereof with the working portion thereof and beyond into the working portion thereof, a second outlet piston mounted in an associated second cylinder of each of said second plurality of cylinders constructed and arranged to be moved in sealing relation to the associated second cylinder from an outlet end position wherein the outlet port thereof is communicated with the working portion thereof in an axial direction away from said outlet end position into an outlet port cut-off position wherein said outlet piston cuts off the communication of the outlet port thereof with the working portion thereof and beyond into the working portion thereof, each first outlet piston having a mass generally equal to the mass of a second outlet piston disposed in mirror image relation thereto so as to be statically balanced therewith, rotor structure within said housing assembly constructed and arranged to move with a rotational movement about said longitudinal axis, a first annular inlet cam disposed annularly about said longitudinal axis on said one side of said central plane, a first inlet cam follower operatively connected between said first annular inlet cam and each of said first inlet pistons so as to effect axial movements thereof in opposite directions during the rotation of the rotor structure about said longitudinal axis, a second annular inlet cam disposed annularly about said longitudinal axis on said opposite side of said central plane, a second inlet cam follower operatively connected between said second annular inlet cam and each of said second inlet pistons so as to effect axial movements thereof in opposite directions during the rotation of the rotor structure about said longitudinal axis, each first inlet cam follower having a mass generally equal to the mass of an associated second inlet cam follower disposed in mirror image relation thereto so as to be statically balanced therewith, a first annular outlet cam disposed annularly about said longitudinal axis on said opposite side of said central plane, a first outlet cam follower operatively connected between said first annular outlet cam and each of said first outlet pistons so as to effect axial movements thereof in opposite directions during the rotation of the rotor structure about said longitudinal axis, a second annular outlet cam disposed annularly about said longitudinal axis on said opposite side of said central plane, a second outlet cam follower operatively connected between said first annular outlet cam and each of said first outlet pistons so as to effect axial movements thereof in opposite directions during the rotation of the rotor structure about said longitudinal axis, each first outlet cam follower having a mass generally equal to the mass of an associated second outlet cam follower disposed in mirror image relation thereto so as to be statically balanced therewith, said first and second inlet and outlet annular cams being configured to move the first and second inlet and outlet pistons respectively within each cylinder through a successive five cycle repeating movement which includes (1) a power cycle wherein said first and second inlet and outlet pistons are moved axially outwardly from combustion positions disposed in closely spaced relation within the working portion of the associated cylinder defining a minimum volume condition into a respective cut-off positions thereof defining a maximum volume condition, (2) an exhaust cycle wherein said first and second outlet pistons are moved from the outlet cut-off position thereof into the outlet end position thereof and said first and second inlet pistons are moved through the working portion thereof into close proximity to said first and second outlet pistons respectively, (3) a transfer cycle wherein said first and second inlet and outlet pistons are moved together in close proximity to each other through the working portion thereof, (4) an intake cycle wherein said first and second outlet pistons are initially moved through the working portion of the associated cylinder while the first and second inlet pistons respectively are in a position allowing communication of the first and second inlet ports respectively with the associated working portions with the final movement of said intake cycle resulting in said first and second inlet and outlet pistons being in compression positions spaced from the respective end positions thereof so that the communication of the respective ports are cut off from the working portion of the associated cylinder, and (5) a compression cycle wherein said first and second inlet and outlet pistons are moved from said compression positions thereof toward each other respectively into said combustion positions, the movements of each first inlet piston and an associated first inlet cam follower being accompanied by an equal and opposite movement of a second inlet piston and an associated second inlet cam follower so that all movements of said first and second inlet pistons and the associated first and second inlet cam followers thereof are dynamically balanced, said first inlet and outlet annular cams being configured to retain said first inlet and outlet pistons substantially in said combustion positions longer than simple harmonic motion for a time sufficient to enable a new fueled gas charge within the minimum volume to be ignited and to rise to maximum pressure before substantial volume increase toward said maximum volume during said power cycle takes place to thereby eliminate negative work resulting from ignition prior to reaching the minimum volume condition and to obtain optimal work from optimal pressure conditions, and said second inlet and outlet annular cams being configured to retain said second inlet and outlet pistons substantially in said combustion positions longer than simple harmonic motion for a time sufficient to enable a new fueled gas charge within the minimum volume to be ignited and to rise to maximum pressure before substantial volume increase toward said maximum volume during said power cycle takes place to thereby eliminate negative work resulting from ignition prior to reaching the minimum volume condition and to obtain optimal work from optimal pressure conditions.

2. An internal combustion engine as defined in claim 1 wherein the compression positions of said first inlet and outlet pistons in said intake cycle constitute the cut-off position of one of said first pistons and an intermediate position of the other of said first pistons disposed inwardly of the cut-off position thereof, the compression positions of said second inlet and outlet pistons in said intake cycle constitute the cut-off position of one of said second pistons and an intermediate position of the other of said second pistons disposed inwardly of the cut-off position thereof, the arrangement being such that a compression volume condition with respect to said first and second inlet and outlet pistons is established which is exceeded by the maximum volume condition defined by the respective cut-off positions during the power cycle.

3. An internal combustion engine as defined in claim 2 wherein the first and second outlet annular cams are configured to effect cyclic movements of said first and second outlet pistons between the first and second outlet cut-off positions respectively and the first and second outlet end positions thereof respectively and said first and second inlet annular cams are configured to move the first and second inlet pistons from the inlet cut-off positions thereof to intermediate positions within an associated central working portion during the cyclic movements of said first and second outlet pistons so as to positively displace a volume of air through the associated first and second outlet ports respectively.

4. An internal combustion engine as defined in claim 3 wherein said cylinders are fixed with respect to said housing and said annular cams are fixed with respect to said rotor structure to rotate therewith.

5. An internal combustion engine as defined in claim 4 wherein each annular cam includes a radially outwardly extending annular flange having opposed axially facing cam surfaces and each cam follower includes a pair of rollers mounted with respect to an associated piston to roll on said cam surfaces during rotational movement of said rotor structure.

6. An internal combustion engine as defined in claim 5 wherein each cam follower includes a piston rod having one end fixed to an associated piston for axial movements therewith and a free end which carries an associated pair of rollers, an axially extending guide member fixed to said housing assembly and a cross member connected with the free end of an associated piston rod slidably mounted on an associate guide member.

7. An internal combustion engine as defined in claim 1 wherein the compression positions of said first inlet and outlet pistons in said intake cycle constitute the cut-off position of one of said first pistons and an intermediate position of the other of said first pistons disposed inwardly of the cut-off position thereof, the compression positions of said second inlet and outlet pistons in said intake cycle constitute the cut-off position of one of said second pistons and an intermediate position of the other of said second pistons disposed inwardly of the cut-off position thereof.

8. An internal combustion engine as defined in claim 7 wherein the first and second outlet annular cams are configured to effect cyclic movements of said first and second outlet pistons between the first and second outlet cut-off positions respectively and the first and second outlet end positions thereof respectively and said first and second inlet annular cams are configured to move the first and second inlet pistons from the inlet cut-off positions thereof to intermediate positions within an associated central working portion during the cyclic movements of said first and second outlet pistons so as to positively displace a volume of air through the associated first and second outlet ports respectively.

9. An internal combustion engine as defined in claim 1 wherein said cylinders are fixed with respect to said housing and said annular cams are fixed with respect to said rotor structure to rotate therewith.

10. An internal combustion engine as defined in claim 1 wherein each annular cam includes a radially outwardly extending annular flange having opposed axially facing cam surfaces and each cam follower includes a pair of rollers mounted with respect to an associated piston to roll on said cam surfaces during rotational movement of said rotor structure.

11. An internal combustion engine as defined in claim 10 wherein each cam follower includes a piston rod having one end fixed to an associated piston for axial movements therewith and a free end which carries an associated pair of rollers, an axially extending guide member fixed to said housing assembly and a cross member connected with the free end of an associated piston rod slidably mounted on an associate guide member.

12. A balanced five cycle internal combustion engine comprising:

a housing assembly having a longitudinal axis and a central plane perpendicular to said longitudinal axis, a plurality of first cylinders in said housing assembly on one side of said central plane having parallel axes disposed in annularly spaced relation about said longitudinal axis, a plurality of second cylinders in said housing assembly on an opposite side of said central plane and disposed in coaxial mirror image relation with respect to said plurality of first cylinders respectively, each of said plurality of first and second cylinders each including an inlet end portion having an inlet port therein, a central working portion and an outlet end portions having an outlet port therein, the inlet end portion, the central working portion and the outlet end portion of said plurality of first cylinders being arranged in mirror image relation with respect to the inlet end portion, the central working portion and the outlet end portion of said plurality of second cylinders respectively, a first inlet piston mounted in an associated first cylinder constructed and arranged to be moved in sealing relation to the associated first cylinder from an inlet end position wherein the inlet port thereof communicates with the working portion thereof in an axial direction away from said inlet end position into an inlet port cut-off position wherein said inlet piston cuts off communication of the inlet port thereof with the working portion thereof and beyond into the working portion thereof, a second inlet piston mounted in an associated second cylinder constructed and arranged to be moved in sealing relation to the associated second cylinder from an inlet end position wherein the inlet port thereof communicates with the working portion thereof in an axial direction away from said inlet end position into an inlet port cut-off position wherein said inlet piston cuts off communication of the inlet port thereof with the working portion thereof and beyond into the working portion thereof, each first inlet piston having a mass generally equal to the mass of a second inlet piston disposed in mirror image relation thereof so as to be statically balanced therewith, a first outlet piston mounted in an associated first cylinder of each of said first plurality of cylinders constructed and arranged to be moved in sealing relation to the associated cylinder from an outlet end position wherein the outlet port thereof is communicated with the working portion thereof in an axial direction away from said outlet end position into an outlet port cut-off position wherein said outlet piston cuts off the communication of the outlet port thereof with the working portion thereof and beyond into the working portion thereof, a second outlet piston mounted in an associated second cylinder of each of said second plurality of cylinders constructed and arranged to be moved in sealing relation to the associated second cylinder from an outlet end position wherein the outlet port thereof is communicated with the working portion thereof in an axial direction away from said outlet end position into an outlet port cut-off position wherein said outlet piston cuts off the communication of the outlet port thereof with the working portion thereof and beyond into the working portion thereof, each first outlet piston having a mass generally equal to the mass of a second outlet piston disposed in mirror image relation thereto so as to be statically balanced therewith, rotor structure within said housing assembly constructed and arranged to move with a rotational movement about said longitudinal axis, a first annular inlet cam disposed annularly about said longitudinal axis on said one side of said central plane, a first inlet cam follower operatively connected between said first annular inlet cam and each of said first inlet pistons so as to effect axial movements thereof in opposite directions during the rotation of the rotor structure about said longitudinal axis, a second annular inlet cam disposed annularly about said longitudinal axis on said opposite side of said central plane, a second inlet cam follower operatively connected between said second annular inlet cam and each of said second inlet pistons so as to effect axial movements thereof in opposite directions during the rotation of the rotor structure about said longitudinal axis, each first inlet cam follower having a mass generally equal to the mass of an associated second inlet cam follower disposed in mirror image relation thereto so as to be statically balanced therewith, a first annular outlet cam disposed annularly about said longitudinal axis on said opposite side of said central plane, a first outlet cam follower operatively connected between said first annular outlet cam and each of said first outlet pistons so as to effect axial movements thereof in opposite directions during the rotation of the rotor structure about said longitudinal axis, a second annular outlet cam disposed annularly about said longitudinal axis on said opposite side of said central plane, a second outlet cam follower operatively connected between said first annular outlet cam and each of said first outlet pistons so as to effect axial movements thereof in opposite directions during the rotation of the rotor structure about said longitudinal axis, each first outlet cam follower having a mass generally equal to the mass of an associated second outlet cam follower disposed in mirror image relation thereto so as to be statically balanced therewith, said first and second inlet and outlet annular cams being configured to move the first and second inlet and outlet pistons respectively within each cylinder through a successive five cycle repeating movement which includes (1) a power cycle wherein said first and second inlet and outlet pistons are moved axially outwardly from combustion positions disposed in closely spaced relation within the working portion of the associated cylinder defining a minimum volume condition into a respective cut-off positions thereof defining a maximum volume condition, (2) an exhaust cycle wherein said first and second outlet pistons are moved from the outlet cut-off position thereof into the outlet end position thereof and said first and second inlet pistons are moved through the working portion thereof into close proximity to said first and second outlet pistons respectively, (3) a transfer cycle wherein said first and second inlet and outlet pistons are moved together in close proximity to each other through the working portion thereof, (4) an intake cycle wherein said first and second outlet pistons are initially moved through the working portion of the associated cylinder while the first and second inlet pistons respectively are in a position allowing communication of the first and second inlet ports respectively with the associated working portions with the final movement of said intake cycle resulting in said first and second inlet and outlet pistons being in compression positions spaced from the respective end positions thereof so that the communication of the respective ports are cut off from the working portion of the associated cylinder, and (5) a compression cycle wherein said first and second inlet and outlet pistons are moved from said compression positions thereof toward each other respectively into said combustion positions, the movements of each first inlet piston and an associated first inlet cam follower being accompanied by an equal and opposite movement of a second inlet piston and an associated second inlet cam follower so that all movements of said first and second inlet pistons and the associated first and second inlet cam followers thereof are dynamically balanced, wherein the compression positions of said first inlet and outlet pistons in said intake cycle constitute the cut-off position of one of said first pistons and an intermediate position of the other of said first pistons disposed inwardly of the cut-off position thereof, the compression positions of said second inlet and outlet pistons in said intake cycle constitute the cut-off position of one of said second pistons and an intermediate position of the other of said second pistons disposed inwardly of the cut-off position thereof, the arrangement being such that a compression volume condition with respect to said first and second inlet and outlet pistons is established which is exceeded by the maximum volume condition defined by the respective cut-off positions during the power cycle.

13. A balanced five cycle internal combustion engine comprising:

a housing assembly having a longitudinal axis and a central plane perpendicular to said longitudinal axis, a plurality of first cylinders in said housing assembly on one side of said central plane having parallel axes disposed in annularly spaced relation about said longitudinal axis, a plurality of second cylinders in said housing assembly on an opposite side of said central plane and disposed in coaxial mirror image relation with respect to said plurality of first cylinders respectively, each of said plurality of first and second cylinders each including an inlet end portion having an inlet port therein, a central working portion and an outlet end portions having an outlet port therein, the inlet end portion, the central working portion and the outlet end portion of said plurality of first cylinders being arranged in mirror image relation with respect to the inlet end portion, the central working portion and the outlet end portion of said plurality of second cylinders respectively, a first inlet piston mounted in an associated first cylinder constructed and arranged to be moved in sealing relation to the associated first cylinder from an inlet end position wherein the inlet port thereof communicates with the working portion thereof in an axial direction away from said inlet end position into an inlet port cut-off position wherein said inlet piston cuts off communication of the inlet port thereof with the working portion thereof and beyond into the working portion thereof, a second inlet piston mounted in an associated second cylinder constructed and arranged to be moved in sealing relation to the associated second cylinder from an inlet end position wherein the inlet port thereof communicates with the working portion thereof in an axial direction away from said inlet end position into an inlet port cut-off position wherein said inlet piston cuts off communication of the inlet port thereof with the working portion thereof and beyond into the working portion thereof, each first inlet piston having a mass generally equal to the mass of a second inlet piston disposed in mirror image relation thereof so as to be statically balanced therewith, a first outlet piston mounted in an associated first cylinder of each of said first plurality of cylinders constructed and arranged to be moved in sealing relation to the associated cylinder from an outlet end position wherein the outlet port thereof is communicated with the working portion thereof in an axial direction away from said outlet end position into an outlet port cut-off position wherein said outlet piston cuts off the communication of the outlet port thereof with the working portion thereof and beyond into the working portion thereof, a second outlet piston mounted in an associated second cylinder of each of said second plurality of cylinders constructed and arranged to be moved in sealing relation to the associated second cylinder from an outlet end position wherein the outlet port thereof is communicated with the working portion thereof in an axial direction away from said outlet end position into an outlet port cut-off position wherein said outlet piston cuts off the communication of the outlet port thereof with the working portion thereof and beyond into the working portion thereof, each first outlet piston having a mass generally equal to the mass of a second outlet piston disposed in mirror image relation thereto so as to be statically balanced therewith, rotor structure within said housing assembly constructed and arranged to move with a rotational movement about said longitudinal axis, a first annular inlet cam disposed annularly about said longitudinal axis on said one side of said central plane, a first inlet cam follower operatively connected between said first annular inlet cam and each of said first inlet pistons so as to effect axial movements thereof in opposite directions during the rotation of the rotor structure about said longitudinal axis, a second annular inlet cam disposed annularly about said longitudinal axis on said opposite side of said central plane, a second inlet cam follower operatively connected between said second annular inlet cam and each of said second inlet pistons so as to effect axial movements thereof in opposite directions during the rotation of the rotor structure about said longitudinal axis, each first inlet cam follower having a mass generally equal to the mass of an associated second inlet cam follower disposed in mirror image relation thereto so as to be statically balanced therewith, a first annular outlet cam disposed annularly about said longitudinal axis on said opposite side of said central plane, a first outlet cam follower operatively connected between said first annular outlet cam and each of said first outlet pistons so as to effect axial movements thereof in opposite directions during the rotation of the rotor structure about said longitudinal axis, a second annular outlet cam disposed annularly about said longitudinal axis on said opposite side of said central plane, a second outlet cam follower operatively connected between said first annular outlet cam and each of said first outlet pistons so as to effect axial movements thereof in opposite directions during the rotation of the rotor structure about said longitudinal axis, each first outlet cam follower having a mass generally equal to the mass of an associated second outlet cam follower disposed in mirror image relation thereto so as to be statically balanced therewith, said first and second inlet and outlet annular cams being configured to move the first and second inlet and outlet pistons respectively within each cylinder through a successive five cycle repeating movement which includes (1) a power cycle wherein said first and second inlet and outlet pistons are moved axially outwardly from combustion positions disposed in closely spaced relation within the working portion of the associated cylinder defining a minimum volume condition into a respective cut-off positions thereof defining a maximum volume condition, (2) an exhaust cycle wherein said first and second outlet pistons are moved from the outlet cut-off position thereof into the outlet end position thereof and said first and second inlet pistons are moved through the working portion thereof into close proximity to said first and second outlet pistons respectively, (3) a transfer cycle wherein said first and second inlet and outlet pistons are moved together in close proximity to each other through the working portion thereof, (4) an intake cycle wherein said first and second outlet pistons are initially moved through the working portion of the associated cylinder while the first and second inlet pistons respectively are in a position allowing communication of the first and second inlet ports respectively with the associated working portions with the final movement of said intake cycle resulting in said first and second inlet and outlet pistons being in compression positions spaced from the respective end positions thereof so that the communication of the respective ports are cut off from the working portion of the associated cylinder, and (5) a compression cycle wherein said first and second inlet and outlet pistons are moved from said compression positions thereof toward each other respectively into said combustion positions, the movements of each first inlet piston and an associated first inlet cam follower being accompanied by an equal and opposite movement of a second inlet piston and an associated second inlet cam follower so that all movements of said first and second inlet pistons and the associated first and second inlet cam followers thereof are dynamically balanced, wherein the first and second outlet annular cams being configured to effect cyclic movements of said first and second outlet pistons between the first and second outlet cut-off positions respectively and the first and second outlet end positions thereof respectively and said first and second inlet annular cams being configured to move the first and second inlet pistons from the inlet cut-off positions thereof to intermediate positions within an associated central working portion during the cyclic movements of said first and second outlet pistons so as to positively displace a volume of air through the associated first and second outlet ports respectively.

* * * * *